US009482980B1

(12) United States Patent
Watanabe

(10) Patent No.: US 9,482,980 B1
(45) Date of Patent: Nov. 1, 2016

(54) IMAGE FORMING APPARATUS

(71) Applicant: FUJI XEROX CO., LTD., Tokyo (JP)

(72) Inventor: Sho Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/988,093

(22) Filed: Jan. 5, 2016

(30) Foreign Application Priority Data

Jul. 9, 2015 (JP) ..... 2015-137774

(51) Int. Cl.
*G03G 15/01* (2006.01)
*G03G 15/08* (2006.01)

(52) U.S. Cl.
CPC ..... *G03G 15/0131* (2013.01); *G03G 15/0831* (2013.01)

(58) Field of Classification Search
CPC ..... G03G 15/0131; G03G 15/0831
USPC ..... 399/27, 28, 298
See application file for complete search history.

(56) References Cited

U.S. PATENT DOCUMENTS

2013/0078562 A1* 3/2013 Takahashi ..... G03G 9/0819 430/105
2014/0356035 A1* 12/2014 Harashima ..... G03G 15/2039 399/321

FOREIGN PATENT DOCUMENTS

JP 2006-317633 A 11/2006
JP 2011-174970 A 9/2011
JP 2014-044236 A 3/2014

* cited by examiner

*Primary Examiner* — Hoang Ngo
(74) *Attorney, Agent, or Firm* — Oliff PLC

(57) ABSTRACT

An image forming apparatus includes a forming unit and a transfer unit. The forming unit forms a first image using a first toner including a flat pigment containing a first metal or a first metal oxide, and forms a second image using a second toner that does not include any flat pigment containing a second metal or a second metal oxide, a maximum length of the second toner being smaller than that of the first toner. The transfer unit transfers the second image and the first image to a medium in order of the second image and the first image.

12 Claims, 17 Drawing Sheets

FIG. 15

| | SILVER | WHITE | CYAN |
|---|---|---|---|
| EMBODIMENT | A | A | A |
| COMPARISON EXAMPLE | C | B | A |

IMAGE FORMING APPARATUS

CROSS-REFERENCE TO RELATED APPLICATIONS

This application is based on and claims priority under 35 USC 119 from Japanese Patent Application No. 2015-137774 filed Jul. 9, 2015.

BACKGROUND (i) Technical Field

The present invention relates to an image forming apparatus.

(ii) Related Art

As an image forming apparatus, there is an apparatus which forms a first image using a first toner which includes flat pigment which contains metal, or metal oxide, and forms a second image using a second toner that does not include the flat pigment that contains metal or metal oxide, in which a maximum length of the second toner is smaller than that of the first toner.

In the apparatus, since the flat pigment has conductivity, charge injection into the flat pigment may occur when the first image is transferred to a medium such as an intermediate transfer body from a forming unit which includes a photoconductor, or the like. When charges are injected into a pigment, a polarity of a flat toner may be reversed, and the toner is retransferred to the forming unit. In this case, a transfer ratio when the first image is transferred to a medium from the forming unit decreases.

Specifically, in an image forming apparatus in which a first image and a second image are transferred to a medium in this order, charges may be injected into a flat pigment when the first image and second image are transferred, and thus a transfer ratio when the first image is transferred to from the forming unit the medium may further decrease.

SUMMARY

According an aspect of the invention, an image forming apparatus includes a forming unit and a transfer unit. The forming unit forms a first image using a first toner including a flat pigment containing a first metal or a first metal oxide, and forms a second image using a second toner that does not include any flat pigment containing a second metal or a second metal oxide, a maximum length of the second toner being smaller than that of the first toner. The transfer unit transfers the second image and the first image to a medium in order of the second image and the first image.

BRIEF DESCRIPTION OF THE DRAWINGS

Exemplary embodiments of the present invention will be described in detail based on the following figures, wherein:

FIG. 15 is a table which shows an evaluation result;

DETAILED DESCRIPTION

Hereinafter, exemplary embodiments of the invention will be described based on drawings. In addition, an arrow H in each figure denotes a vertical direction, and an arrow W denotes a horizontal direction and a width direction of an apparatus.

(Image Forming Apparatus 10)

Figure 1:
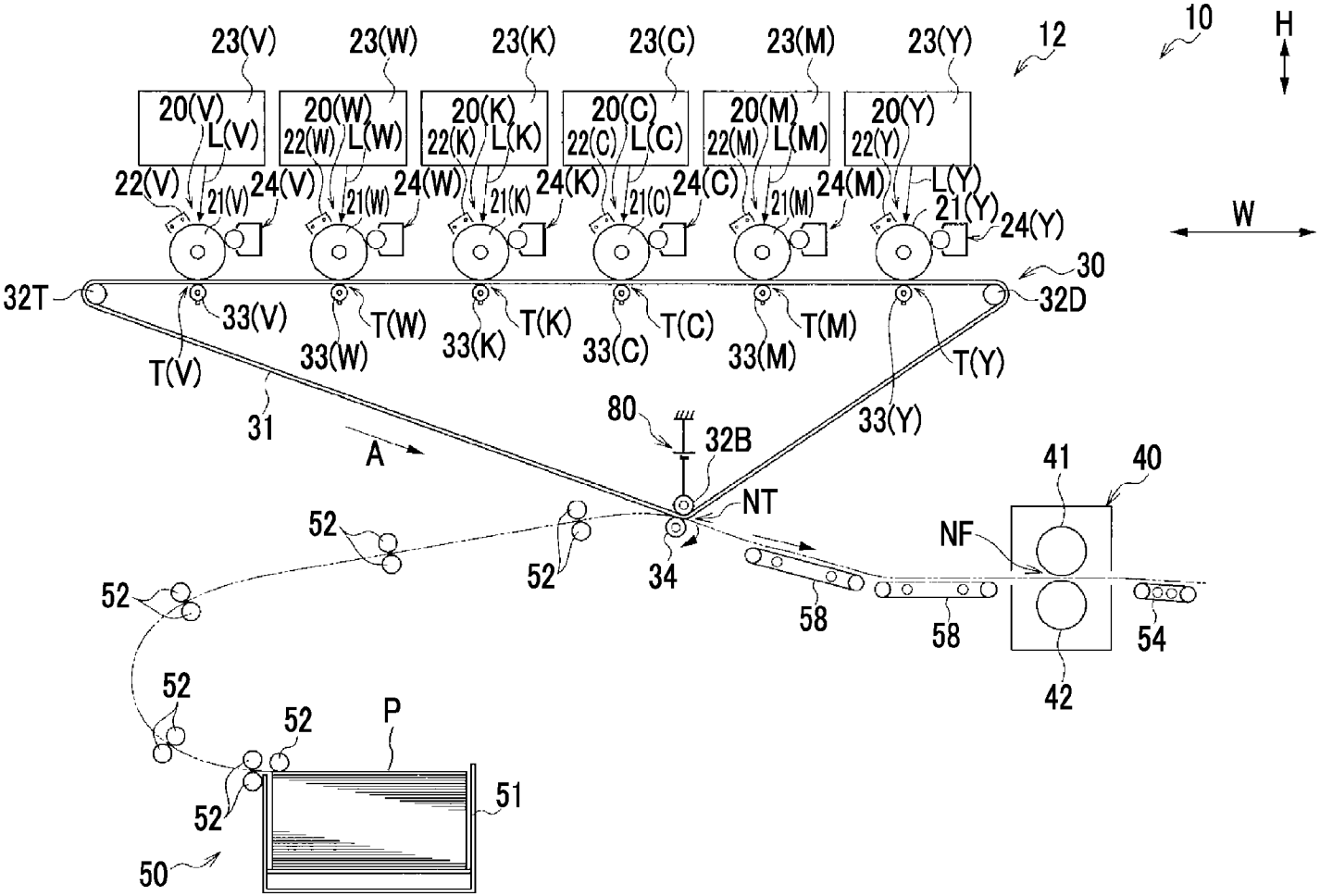
FIG. 1 is a schematic diagram which shows an image forming apparatus according to an exemplary embodiment.

First, a configuration of an image forming apparatus 10 will be described. FIG. 1 is a schematic view which shows a configuration of the image forming apparatus 10 which is viewed from the front side.

The image forming apparatus 10 is an apparatus which forms an image on a recording medium P such as a sheet using an electro-photographic system, and is set to a tandem-type image forming apparatus. Specifically, as shown in FIG. 1, the image forming apparatus 10 includes a toner image forming unit 12 (an example of forming unit) that forms a toner image, and a transfer unit 30 that transfers the toner image which is formed using the toner image forming unit 12 onto the recording medium P. The image forming apparatus 10 further includes a fixing unit 40 that fixes the toner image which is transferred to the recording medium P onto the recording medium P by heating and pressurizing the toner image, and a transport unit 50 that transports the recording medium P. Hereinafter, specific configurations of the transport unit 50, the toner image forming unit 12, the transfer unit 30, and the fixing unit 40 will be described.

(Transport Unit 50)

As shown in FIG. 1, the transport unit 50 includes a container 51 in which the recording medium P is accommodated, and plural transport rollers 52 that transport the recording medium P to a secondary transfer position NT from the container 51. The transport unit 50 further includes plural transport belts 58 that transport the recording medium P to the fixing unit 40 from the secondary transfer position NT, and a transport belt 54 that transports the recording medium P toward a discharging unit (not shown) of the recording medium P from the fixing unit 40.

(Toner Image Forming Unit 12)

As shown in FIG. 1, the toner image forming unit 12 includes image forming units 20Y, 20M, 20C, 20K, 20W, and 20V (image forming section) that form toner images of each color of yellow (Y), magenta (M), cyan (C), black (K), white (W), and silver (V). The image forming units 20Y, 20M, 20C, 20K, 20W, and 20V (hereinafter, referred to as 20Y to 20V) are arranged in this order from the upstream side to the downstream side in the transport direction of a transfer belt 31 that will be described later.

(Y), (M), (C), (K), (W) and (V) which are shown in FIG. 1 denote configuration portions corresponding to each of the colors. In addition, in descriptions of the specification, when describing colors by classifying the colors, (Y), (M), (C), (K), (W) and (V) are attached to reference numerals. In addition, when attaching (Y), (M), (C), (K), (W) and (V) to the reference numerals, there is a case of being described as Y, M, C, K, W, and V by omitting parentheses. In addition, hereinafter, yellow (Y), magenta (M), cyan (C), and black (K) will be referred to as a "colored color" collectively.

(Image Forming Unit 20)

Figure 2:
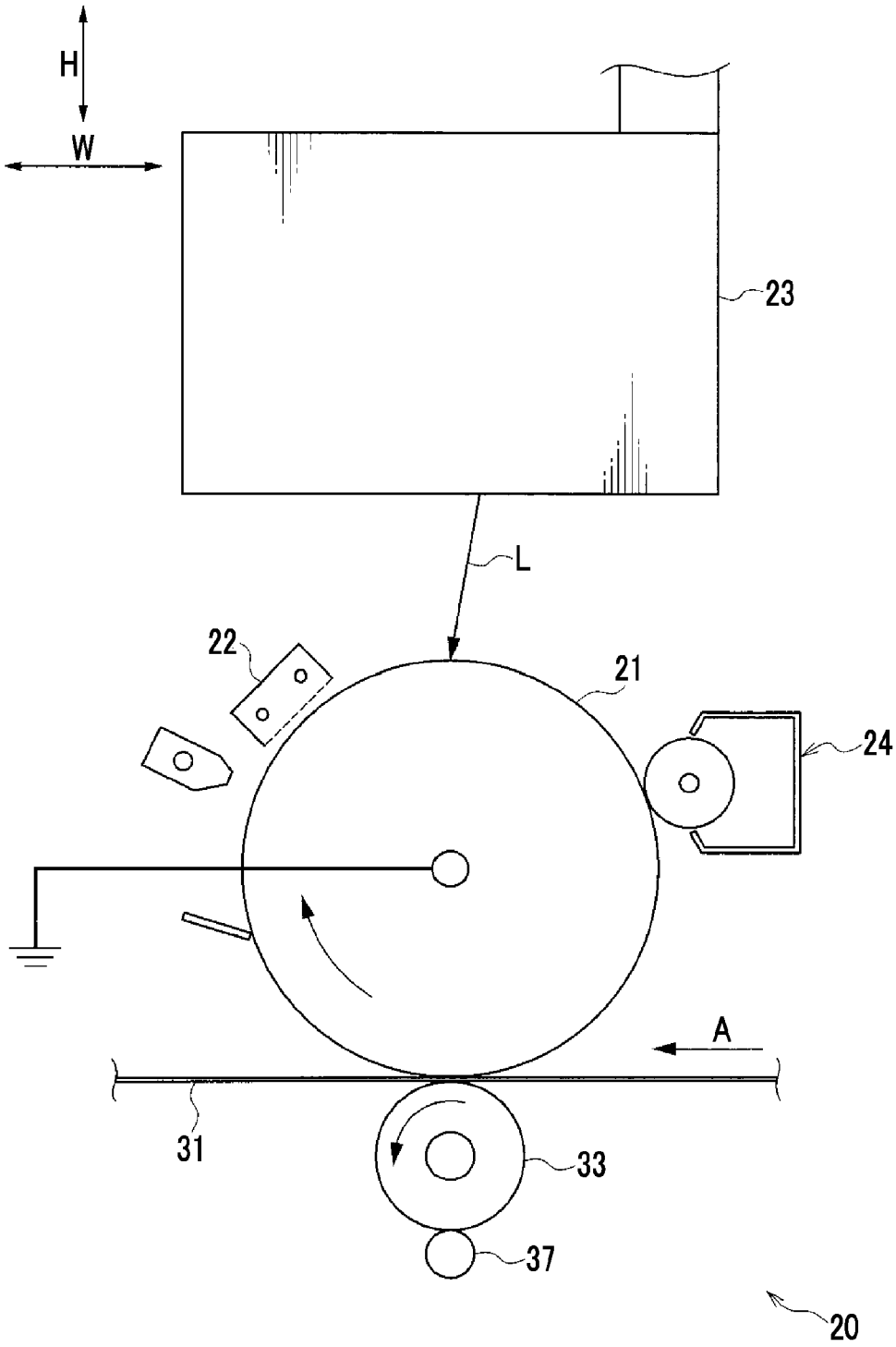
FIG. 2 is a schematic diagram which shows an image forming unit according to the exemplary embodiment.

The image forming unit 20 of each color has the same configuration, basically, except for the toner to be used. Specifically, as shown in FIG. 2, the image forming unit 20 of each color includes a photoconductor drum 21 that rotates clockwise as shown in FIG. 2, and a charger 22 that charges the photoconductor drum 21. In addition, the image forming unit 20 of each color includes an exposure unit 23 that forms an electrostatic latent image on the photoconductor drum 21 by exposing the photoconductor drum 21 that is charged using the charger 22, and a developing device 24 that forms a toner image by developing the electrostatic latent image which is formed on the photoconductor drum 21 using the exposure unit 23.

Specifically, the exposure unit 23 forms the electrostatic latent image on the photoconductor drum 21 by radiating exposure light which is modulated according to image data to the photoconductor drum 21. When the electrostatic latent image is developed using the developing device 24, a toner image based on the image data is formed. As image data, for example, there is image data, or the like, which is generated in an external device (not shown), and is obtained by the image forming apparatus 10 from the external device.

In addition, in the image forming unit 20V, a toner image (an example of first image) is formed using silver toner 100 (refer to FIGS. 4A and 4B) as an example of a first toner. In addition, hereinafter, for ease of description, a toner image which is formed using the silver toner is referred to as a "silver image".

Figure 6A:
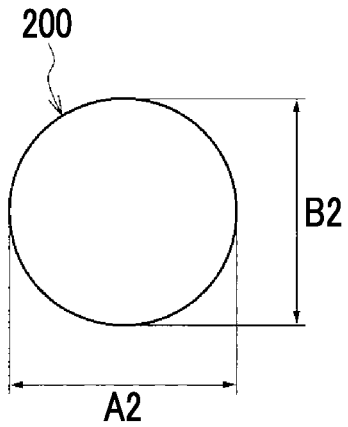
FIGS. 6A and 6B are a plan view and a side view of the white toner.
Figure 6B:
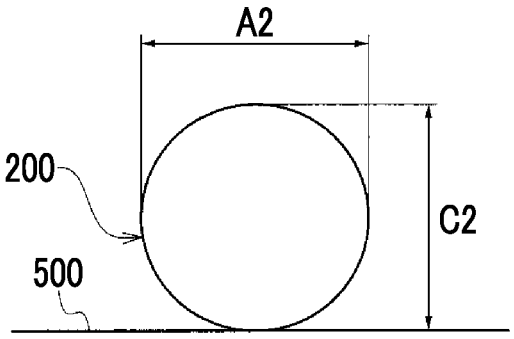

In addition, in the image forming unit 20W, a toner image (an example of second image) is formed using a white toner 200 (refer to FIGS. 6A and 6B) as an example of a second toner. In addition, hereinafter, for ease of description, a toner image which is formed using the white toner is referred to as a "white image".

Figure 8A:
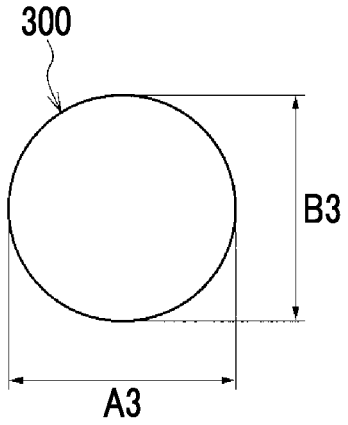
FIGS. 8A and 8B are a plan view and a side view of the color toner.
Figure 8B:
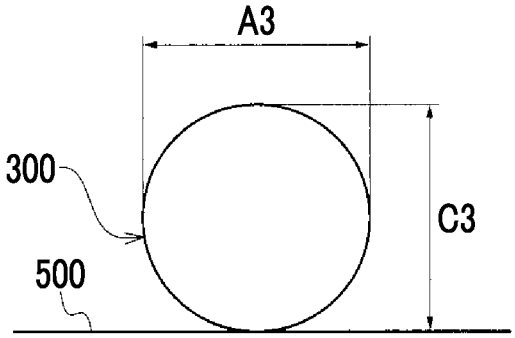

In the image forming units 20Y, 20M, 20C, and 20K (hereinafter, denoted by 20Y to 20K), toner images (an example of third image) are formed using a color toner 300 (refer to FIGS. 8A and 8B) as an example of a third toner. In addition, hereinafter, for ease of description, a toner image which is formed using the color toner 300 is referred to as a "color image". In addition, specific configurations of the silver toner 100, the white toner 200, and the color toner 300 will be described later.

(Transfer Unit 30)

The transfer unit 30 primarily transfers a toner image of the photoconductor drum 21 of each color to the transfer belt 31 (intermediate transfer member) by superimposing the toner image, and secondarily transfers the superimposed toner image to the recording medium P at the secondary transfer position NT. Specifically, as shown in FIG. 1, the transfer unit 30 includes the transfer belt 31 (an example of medium) on which a toner image is transferred, and transfers the toner image to the recording medium P, a primary transfer roll 33 (an example of transfer section), and a secondary transfer roll 34.

(Transfer Belt 31)

As shown in FIG. 1, the transfer belt 31 is in an endless shape, and a posture thereof is determined by being wound on plural rolls 32. In the exemplary embodiment, the transfer belt 31 has a shape of an inverted triangle with an obtuse angle which is long in the width direction of the apparatus in a front view. The roll 32D in FIG. 1 among the plural rolls 32 functions as a driving roll which causes the transfer belt 31 to circulate in an arrow A direction using power of a motor which is not shown. The transfer belt 31 transports a toner image of each color which is primarily transferred to the secondary transfer position NT from a primary transfer position T of each color by circulating in the arrow A direction.

In addition, of the plural rolls 32, a roll 32T shown in FIG. 1 functions as a tension applying roll which applies tension to the transfer belt 31. Of the plural rolls 32, a roll 32B shown in FIG. 1 functions as a facing roll 32B of the secondary transfer roll 34. On the facing roll 32B, an apex portion of the transfer belt on the downstream side which forms an obtuse angle of the transfer belt 31 which is in the inverted triangle shape with an obtuse angle, as described above, is wound. The transfer belt 31 contacts with each photoconductor drum 21 from below at an upper side at which the transfer belt extends in the width direction of the apparatus in the above described shape.

(Primary Transfer Roll 33)

The primary transfer roll 33 is a roll that transfers a toner image of each photoconductor drum 21 to the transfer belt 31, and is arranged inside the transfer belt 31. Each primary transfer roll 33 is arranged so as to face a photoconductor drum 21 of a corresponding color by interposing the transfer belt 31 therebetween. In addition, a primary transfer voltage (primary transfer current) with a polarity reverser to a toner polarity is applied to the primary transfer roll 33 using a power feeding unit 37 (refer to FIG. 2). In this manner, a transfer electric field is formed between the photoconductor drum 21 and the primary transfer roll 33 of the image forming unit 20, an electrostatic force works on a toner image which is formed in the photoconductor drum 21, and the toner image is transferred to the transfer belt 31 at the primary transfer position T.

According to the exemplary embodiment, toner images of the respective colors which are formed in the image forming units 20Y to 20V are transferred to the transfer belt 31 using the primary transfer roll 33 of the respective colors, in order of a yellow color, a magenta color, a cyan color, a black color, a white color, and a silver color.

(Secondary Transfer Roll 34)

The secondary transfer roll 34 is a roll that transfers toner images which are superimposed on the transfer belt 31 to the recording medium P. As shown in FIG. 1, the secondary transfer roll 34 is arranged so as to interpose the transfer belt 31 between the facing roll 32B and the secondary transfer roll, and the secondary transfer roll 34 and the transfer belt 31 contact with each other using a predetermined load. A position between the secondary transfer roll 34 and the transfer belt 31 which are in contact in this manner becomes the secondary transfer position NT. The recording medium P is supplied to the secondary transfer position NT from the container 51 at a proper time. The secondary transfer roll 34 is rotatably driven clockwise, which is shown in FIG. 1.

In addition, in the secondary transfer roll 34, a voltage with a negative polarity is applied to the facing roll 32B using the power feeding unit 80, and a potential difference occurs between the facing roll 32B and the secondary transfer roll 34. That is, when the voltage with the negative polarity is applied to the facing roll 32B, a secondary transfer voltage with a polarity reverse to a toner polarity (voltage with positive polarity) is indirectly applied to the secondary transfer roll 34 that forms an opposing electrode of the facing roll 32B. In this manner, a transfer electric field is formed between the facing roll 32B and the secondary transfer roll 34, an electrostatic force works on a toner image of the transfer belt 31, and the toner image is transferred to the recording medium P which passes through the secondary transfer position NT from the transfer belt 31.

(Fixing Unit 40)

The fixing unit 40 is configured so that a toner image is fixed to the recording medium P by pressurizing the toner image while heating the image in a fixing nip NF which is formed by a fixing roll 41 and a pressurizing roll 42.

(Silver Toner 100)

Figure 9A:
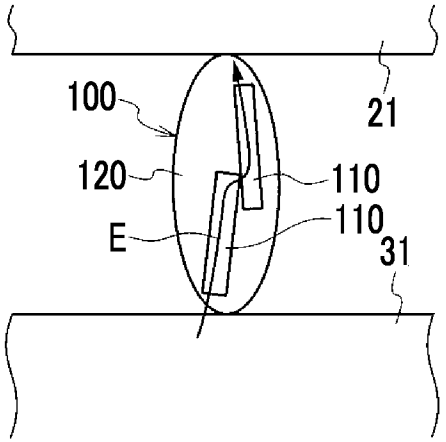
FIGS. 9A to 9C are side views which show the silver toner, the white toner, and the color toner.

The silver toner 100 (flat toner) is configured by including flat pigment 110 and a binding resin 120, as shown in FIG. 9A. The flat pigment 110 is configured of aluminum (an example of metal). A well-known resin material is used in the binding resin 120, and the binding resin 120 has lower conductivity than that of the flat pigment 110.

Figure 3A:
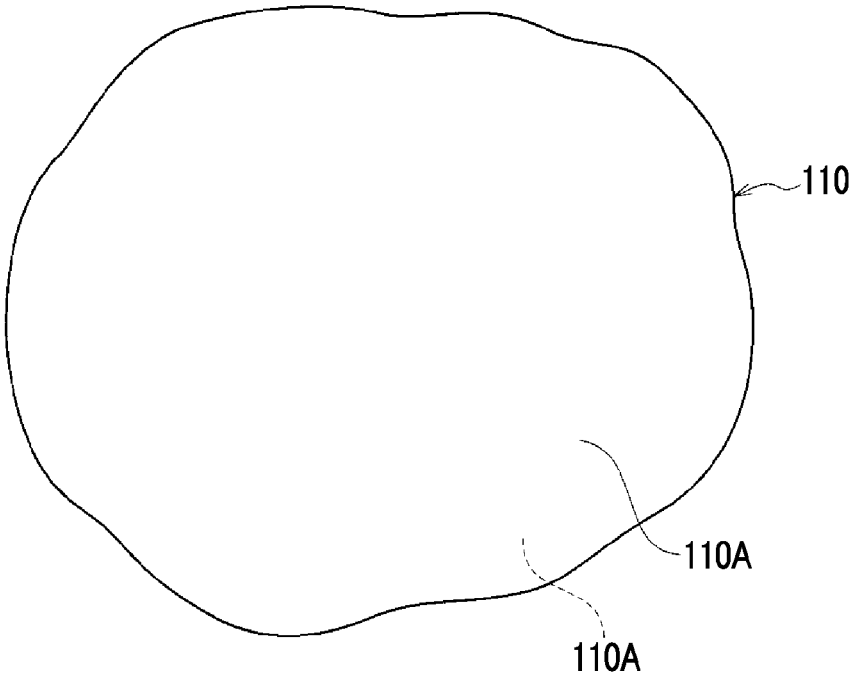
FIGS. 3A and 3B are a plan view and a side view of flat pigment which is included in a silver toner.
Figure 3B:
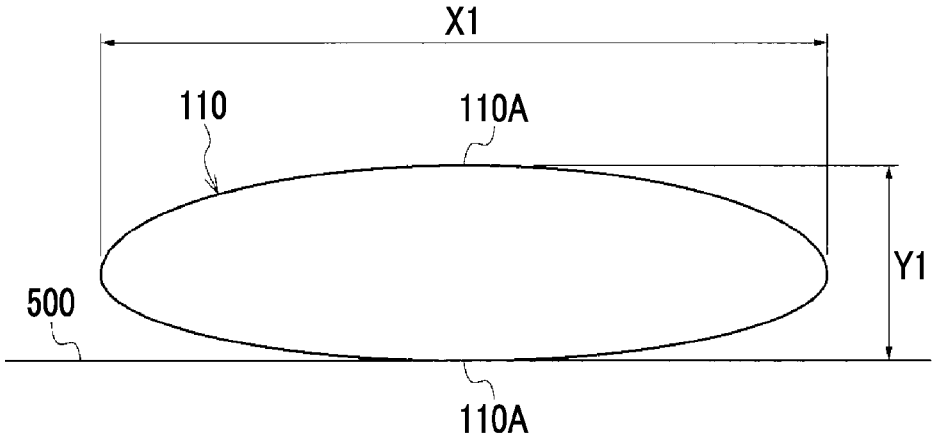

As shown in FIG. 3B, when the flat pigment 110 is viewed from a side in a state in which the flat pigment 110 is placed on a plane 500, the flat pigment 110 has a shape in which a length X1 in right and left directions is longer than a length Y1 in the vertical direction.

In addition, when the flat pigment 110 which is shown in FIG. 3B is viewed from above, as shown in FIG. 3A, the flat pigment 110 has a shape which becomes larger than the shape which is viewed from a side, and in a state in which the flat pigment 110 is placed on the plane 500 (refer to FIG. 3B), the flat pigment 110 includes a pair of reflecting faces 110A which face the higher side and the lower side. In this manner, the flat pigment 110 has a flat shape.

Also, the silver toner 100 which includes the flat pigment 110 has a flat shape which resembles the flat pigment 110, when the flat pigment 110 is set to the flat shape. Accordingly, when the silver toner 100 is viewed from a side in a state in which the silver toner 100 is placed on the plane 500, as shown in FIG. 4B, the silver toner 100 has a shape in which a length (A1) in the right and left directions becomes longer than a length (C1) in the vertical direction.

Figure 4A:
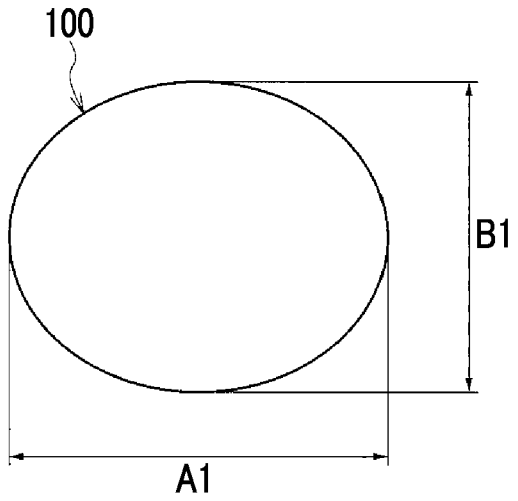
FIGS. 4A and 4B are a plan view and a side view of the silver toner.
Figure 4B:
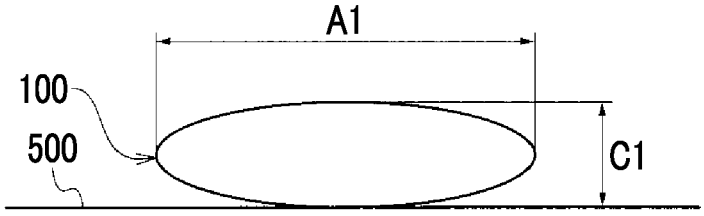

In addition, when the silver toner 100 that is shown in FIG. 4B is viewed from above, as shown in FIG. 4A, the silver toner 100 has a shape which is larger than the shape which is viewed from a side, and an approximately circular shape (approximately oval shape).

A relationship among a maximum length A1 (maximum diameter) when the silver toner 100 is viewed from above, an orthogonal length B1 which is orthogonal to the maximum length A1, and a thickness C1 when the silver toner 100 is viewed from above (length in vertical direction) becomes A1≥B1>C1.

The maximum length A1 is obtained by performing magnifying observation using a color laser microscope "VK-9700" (manufactured by Keyence Corporation), and calculating a maximum length of a toner plane using image processing software.

The maximum length of the silver toner 100 is set, for example, in a range of from 6 μm to 16 μm.

In addition, a value of "thickness C1/orthogonal length B1" may be in a range of from 0.001 to 0.500. When the value of "thickness C1/orthogonal length B1" is 0.001 or more, an intensity of a toner is secured, fracturing due to stress at the time of image forming is suppressed, and a charge reduction due to exposing of pigment, and fog which occurs as a result thereof are suppressed. Meanwhile, when the value of "thickness C1/orthogonal length B1" is 0.500 or less, it is possible to obtain an excellent metallic glossy feeling.

(White Toner 200)

Figure 9B:
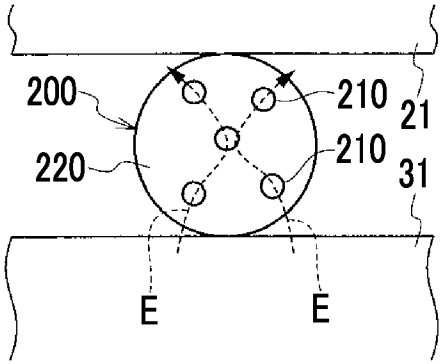

As shown in FIG. 9B, the white toner 200 is configured by including spherical pigment 210 and a binding resin 220. The spherical pigment 210 is formed of titanium oxide (an example of metal oxide). A well-known resin material is used in the binding resin 220, and the binding resin 220 has lower conductivity than that of the spherical pigment 210.

Figure 5A:
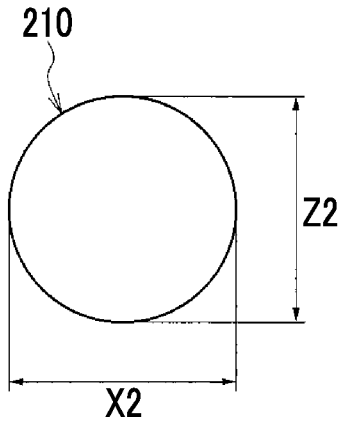
FIGS. 5A and 5B are a plan view and a side view of spherical pigment which is included in a white toner.

In the spherical pigment 210, a length X2 in the right and left directions is equal to or substantially equal to a length Z2 in the forward and backward directions, when the spherical pigment 210 viewed from above (see FIG. 5A) in a state in which the spherical pigment 210 is placed on the plane 500. The length X2 in the right and left directions is equal to or substantially equal to a length Y2 in the vertical direction, when the spherical pigment 210 is viewed from a side (see FIG. 5B) in a state in which the spherical pigment 210 is placed on the plane 500.

Figure 5B:
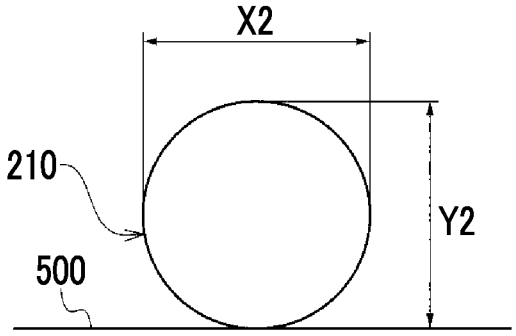

Accordingly, in the spherical pigment 210, a length ratio of the length X2 in the right and left directions to the length Y2 in the vertical direction when viewed from a side, which are shown in FIG. 5B, is smaller than a length ratio in the flat pigment 110. That is, a shape of the spherical pigment 210 is closer to a spherical shape than the shape of the flat pigment 110.

Also the white toner 200 which includes the spherical pigment 210 is set to the spherical shape, similarly to the spherical pigment 210. Accordingly, in the white toner 200, a length A2 in the right and left directions is equal to or substantially equal to a length B2 in the forward and backward directions when the spherical pigment 210 is viewed from above (see FIG. 6A) in the state in which the white toner 200 is placed on the plane 500. The length A2 in the right and left direction is equal to or substantially equal to a length C2 in the vertical direction when the spherical pigment 210 is viewed from a side (see FIG. 6B) in the state in which the white toner 200 is placed on the plane 500.

A maximum length of the white toner 200 is set to be smaller than the maximum length A1 of the silver toner 100. The maximum length of the white toner 200 is set to a volume average particle diameter by assuming that the white toner 200 is in the spherical shape.

The volume average particle diameter is measured using a measuring instrument such as the Coulter Counter TAII (manufactured by Nikkaki Bios Co., Ltd.), and the Multisizer II (manufactured by Nikkaki Bios Co., Ltd.), for example. Specifically, a cumulative particle diameter (D50v) of 50% is set to a volume average particle diameter by drawing a cumulative distribution from a small diameter side in a volume base, with respect to a particle size range (channel) which is divided based on a particle size distribution which is measured using the measuring instrument. In addition, a volume average particle diameter below will be measured in the same manner.

A volume average particle diameter of the spherical pigment 210 is approximately 200 nm to 300 nm. The volume average particle diameter is larger than that of a pigment 310 in the color toner 300; however, it is far smaller than that of the above described flat pigment 110.

A volume average particle diameter of the white toner 200 is set to be in a range of from 4 μm to 14 μm, may be set to be in a range of from 5 μm to 12 μm, and also may be set to be in a range of from 6 μm to 10 μm. When the volume average particle diameter exceeds 14 μm, it is not possible to obtain a good electrificating property (charge amount or charge distribution), or to maintain the proper electrificating property for a long time, and is deficient in reproducibility of fine dots, improvement effects of tone and granularity. Meanwhile, when the volume average particle diameter is less than 4 μm, fog occurs in a background, or density reproducibility easily decreases, since it is difficult to get a sufficient charging ability from a carrier, and not only fluidity of a toner deteriorates.

In addition, density (content) of the spherical pigment 210 with respect to the white toner 200 is set to be in a range of from 20% by weight to 50% by weight.

(Color Toner 300)

Figure 9C:
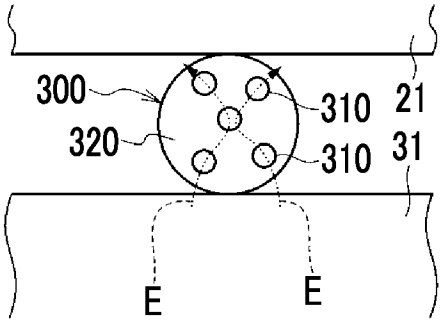

As shown in FIG. 9C, the color toner 300 is configured by including the pigment 310 other than the flat pigment 110 and the spherical pigment 210, and the binding resin 320 without including the flat pigment 110 and the spherical pigment 210. In the pigment 310, for example, a pigment which is non-metal and non-metal oxide (for example, an organic pigment, or the like,) are used. That is, the color toner 300 includes a pigment with lower conductivity than that of the flat pigment 110 and the spherical pigment 210. In the binding resin 320, a well-known resin material is used.

Figure 7A:
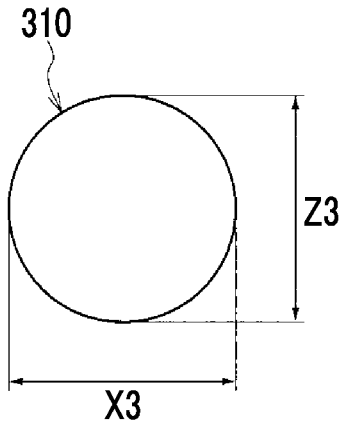
FIGS. 7A and 7B are a plan view and a side view of pigment which is included in a color toner.

In the pigment 310, a length X3 in the right and left directions is equal or substantially equal to a length Z3 in the forward and backward directions when the pigment 310 is viewed from above (see FIG. 7A) in a state in which the pigment 310 is placed on the plane 500. The length X3 in the right and left directions is equal to or substantially equal to a length Y3 in the vertical direction when the pigment 310 is viewed from a side (see FIG. 7B) in the state in which the pigment 310 is placed on the plane 500.

Figure 7B:
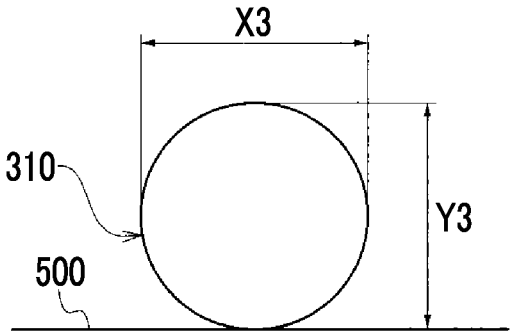

Accordingly, in the pigment 310, a length ratio of the length X3 in the right and left direction to the length Y3 in the vertical direction when viewed from a side, which are shown in FIG. 7B, is smaller than the length ratio in the flat pigment 110. That is, a shape of the pigment 310 is closer to a spherical shape than the shape of the flat pigment 110.

Also the color toner 300 which includes the pigment 310 is set to the spherical shape, similarly to the pigment 310. Accordingly, in the color toner 300, a length A3 in the right and left directions is equal to or substantially equal to a length B3 in the forward and backward directions when the color toner 300 is viewed from above which (see FIG. 8A) in the state in which the color toner 300 is placed on the plane 500. The length A3 in the right and left directions is equal to or substantially equal to a length C3 in the vertical direction when the color toner 300 is viewed from the side (see FIG. 8B) in the state in which the color toner 300 is placed on the plane 500.

A volume average particle diameter of the pigment 310 is approximately 50 nm to 150 nm, and is smaller than that of the above described flat pigment 110 or the spherical pigment 210.

A maximum length of the color toner 300 is set to be smaller than the maximum length (volume average particle diameter) of the white toner 200. A volume average particle diameter of the color toner 300 is set to the maximum length by assuming that color toner 300 is in the spherical shape. In addition, a measuring method of the volume average particle diameter is the same as the method which is described above.

The volume average particle diameter of the color toner 300 may be in a range of from 3 μm to 9 μm, and may also be in a range of from 3 μm to 8 μm. When the particle diameter is less than 3 μm, there is a case in which an electrificating property is insufficient, and reproducibility decreases, and when the particle diameter exceeds 9 μm, there is a case in which a resolution of an image decreases.

In addition, density (content) of the pigment 310 with respect to the color toner 300 is set to a range of from 5% by weight to 20% by weight, for example.

In addition, the color toner 300 may be added with a compound which is formed of a metal element with a valance of 2 or more. The compound is added, for example, as flocculant when manufacturing the color toner 300 using an emulsion polymerization aggregation method. Content of the compound in the color toner 300 is set to a range of from 0.05% by weight to 2% by weight, for example.

In this manner, the color toner 300 may contain metal or metal oxide; however, the content (% by weight) is smaller than those of the silver toner 100 and the white toner 200, and conductivity as toner is lower than those of the silver toner 100 and the white toner 200.

In addition, the color toner 300 may be polymerized toner (chemical toner) which is obtained using a polymerization method such as the emulsion polymerization aggregation method, or may be a grinded toner which is obtained using a grinding method. In addition, the silver toner 100 and the white toner 200 may also be the polymerized toner (chemical toner), or the grinded toner which is obtained using a grinding method, similarly.

(Operations of Exemplary Embodiment)

Subsequently, operations of the exemplary embodiment will be described.

In the image forming apparatus according to the exemplary embodiment, when an image using the silver color, the white color, and the colored color is formed on the recording medium P, the image forming unit 20 of each color, the transfer unit 30, and the fixing unit 40 are operated. In this manner, a toner image is formed in the image forming unit 20 of each color. Specifically, in the image forming unit 20 of each color, a toner image is formed in the following image forming process.

That is, the photoconductor drum 21 of each color is charged using the charger 22 while being rotated. In addition, each exposure unit 23 outputs each exposure light L according to image data, and exposes the light to each photoconductor drum 21 that is charged. Then, an electrostatic latent image is formed on the surface of each photoconductor drum 21. The electrostatic latent image which is formed on each of the photoconductor drums 21 is developed using a developer which is supplied from the developing device 24. In this manner, toner images of yellow (Y), magenta (M), cyan (C), black (K), white (W), and silver (V) are formed on each of the photoconductor drums 21.

Each of the toner images which is formed on the photoconductor drum 21 of each color is sequentially transferred to the transfer belt 31 that circulates, in a transfer electric field which is formed between the photoconductor drum 21 of each color and the primary transfer roll 33 of each color. In this manner, a toner image which is obtained by superimposing toner images of each color is formed on the transfer belt 31. The superimposed toner image is transported to the secondary transfer position NT due to circulating of the transfer belt 31.

In the secondary transfer position NT, the toner image which is superimposed on the transfer belt 31 is transferred to the recording medium P that is transported from the container 51. The toner image transferred to the recording medium P is fixed to the recording medium P by the fixing unit 40.

In this manner, according to the exemplary embodiment, since the toner image of each color is transferred to the recording medium P, an image in which colors of the silver toner 100, the white toner 200, and the color toner 300 are combined and expressed is formed.

Here, there is a case in which charges with a positive polarity are injected into a toner under the transfer electric field which is formed between the photoconductor drum 21 of each color and the primary transfer roll 33 of each color. In a case in which a toner is charged with a positive polarity due to the injection of the charges with the positive polarity, the toner may be retransferred to the photoconductor drum 21 in response to an electrostatic attraction force. When the toner is retransferred to the photoconductor drum 21, a transfer ratio when the toner image is transferred to the transfer belt 31 from the photoconductor drum 21 decreases.

In addition, in the retransfer here, a case in which a toner transferred from the photoconductor drum 21 to the transfer belt 31 is retransferred to the photoconductor drum 21, and a case in which the toner is transferred to the photoconductor drum 21 on the downstream side are included.

In addition, the flat pigment 110 of the silver toner 100 has conductivity since it is metal, and is set to a flat shape. In this manner, since the flat pigment 110 is set to the flat shape, as shown in FIG. 9A, the silver toner 100 easily enters a state in which the longitudinal direction of the flat pigment 110 (longitudinal direction of the silver toner 100) stands up along a direction orthogonal to the transfer belt (hereinafter, referred to as raised state) by being polarized.

Since the flat pigment 110 is present in the silver toner 100 in a state in which the longitudinal direction of the flat pigment 110 goes along the longitudinal direction of the silver toner 100, when the silver toner 100 enters the raised state, a conductive path (refer to arrow E) is secured along the flat pigment 110 between the photoconductor drum 21 and the transfer belt 31. Due to this, charges with a positive polarity are easily injected into the silver toner 100 compared to a case that a toner includes a spherical pigment.

Meanwhile, the spherical pigment 210 of the white toner 200 is metal oxide, and as a result, has conductivity; however, the spherical pigment is set to a spherical shape, not the flat shape (refer to FIG. 9B). For this reason, the spherical pigment 210 is uniformly dispersed in the white toner 200, differently from the flat pigment 110 in the silver toner 100, and is rarely arranged in a specific direction. For this reason, the binding resin 220 with lower conductivity than that of the spherical pigment 210 is present between the spherical pigments 210, and it is difficult to secure a conductive path (refer to arrow E) between the photoconductor drum 21 and the transfer belt 31 compared to the silver toner 100. Due to this, charges with a positive polarity are rarely injected into the white toner 200 compared to the silver toner 100.

In addition, the pigment 310 of the color toner 300 has lower conductivity compared to the flat pigment 110 and the spherical pigment 210. For this reason, it is difficult to secure a conductive path (refer to arrow E) between the photoconductor drum 21 and the transfer belt 31 compared to the silver toner 100 and the white toner 200 (refer to FIG. 9C). Due to this, in the color toner 300, charges with a positive polarity are rarely injected compared to the white toner 200.

Figure 10:
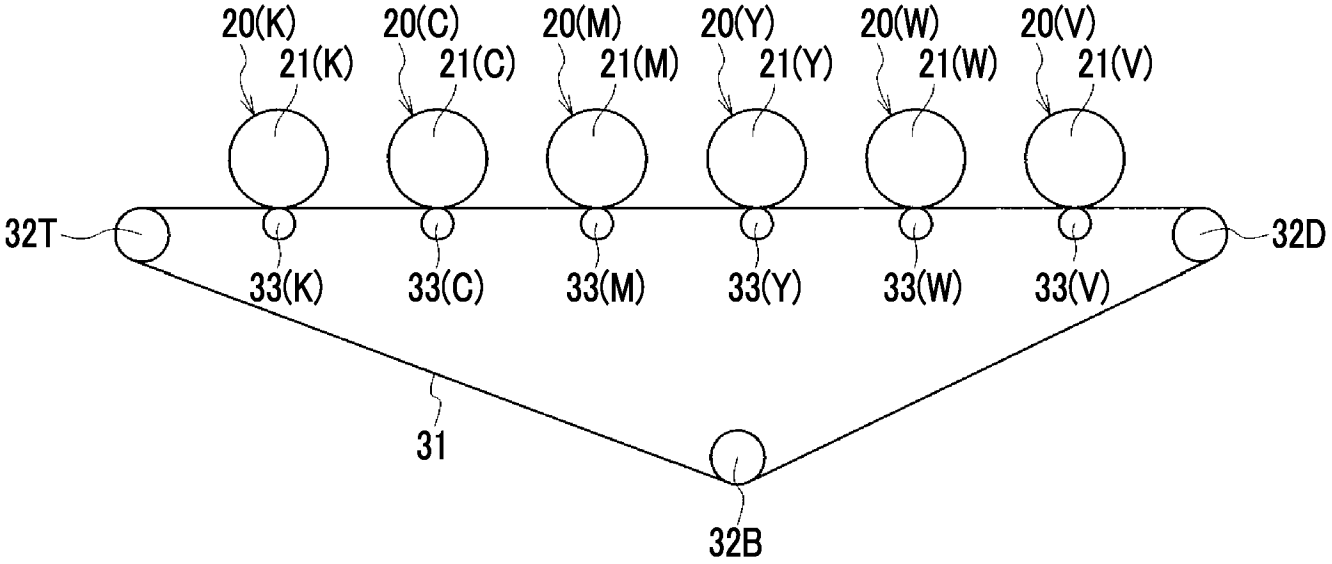
FIG. 10 is a schematic view which shows an image forming apparatus according to a comparison example.

In addition, for example, in a comparison example shown in FIG. 10 in which the image forming units 20V, 20W, and 20Y to 20K are arranged in this order from the upstream side, the silver toner 100 of a silver image which is transferred to the transfer belt 31 from the image forming unit 20V also passes through the primary transfer position T of the image forming units 20W, and 20Y to 20K. As described above, since charges are easily injected into the silver toner 100, when charges are injected into each of the primary transfer positions T under the transfer electric field, a decrease in transfer ratio becomes remarkable.

Figure 11B:
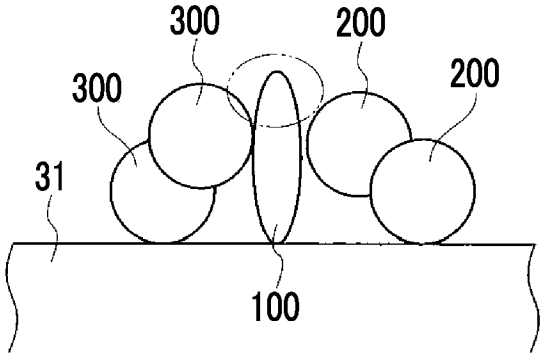
FIGS. 11A and 11B are side views which show a behavior of the silver toner.
Figure 11A:
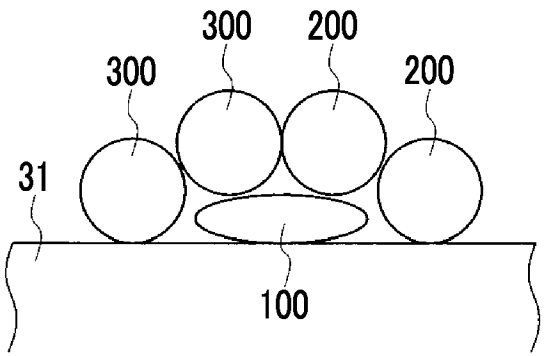
Figure 12:
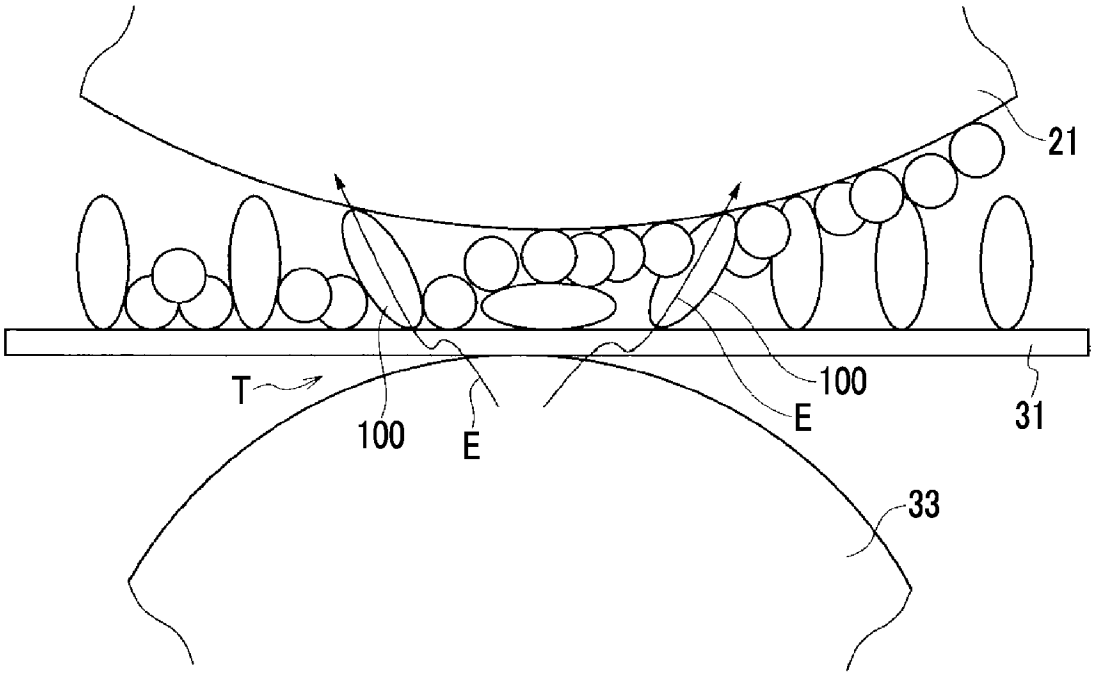
FIG. 12 is a schematic view which shows a behavior of the silver toner in a primary transfer position.

In addition, in the above described comparison example, since the color image and the white image are superimposed on the silver image which is transferred to the transfer belt 31, as shown in FIG. 11A, the white toner 200 and the color toner 300 cover at least a part of the silver toner 100. However, since the maximum length A of the silver toner 100 is longer than the maximum length of the white toner 200 (volume average particle diameter) and the maximum length of the color toner 300 (volume average particle diameter), when the covered silver toner 100 enters the raised state on the transfer belt 31, as described above, as shown in FIG. 11B, in primary transfer positions TW, TY, TC, and TK, a top portion (refer to portion of two-dot dashed line) of the silver toner 100 is easily exposed. For this reason, as shown in FIG. 12, the silver toner 100 contacts with the photoconductor drum 21, and a conductive path (refer to arrow E) is secured along the flat pigment 110 between the photoconductor drum 21 and the transfer belt 31. Due to this, charges with a positive polarity are injected into the silver toner 100, and a transfer ratio easily decreases.

In addition, the volume average particle diameter of the flat pigment 110 that is included in the silver toner 100 is larger than those of the spherical pigment 210 of the white toner 200 and the pigment 310 of the color toner 300. For this reason, the flat pigment 110 easily extends in the silver toner 100 compared to the white toner 200 and the color toner 300, and it is easy to secure a conductive path (refer to arrow E) along the flat pigment 110 between the photoconductor drum 21 and the transfer belt 31. Also in this point, a transfer ratio of the silver toner 100 easily decreases due to the injection of the charges with the positive polarity.

In addition, in the comparison example shown in FIG. 10, since the color image is superimposed on the white image which is transferred to the transfer belt 31, the color toner 300 covers at least a part of the white toner 200. However, since the maximum length (volume average particle diameter) of the white toner 200 is longer than the maximum length (volume average particle diameter) of the color toner 300, similarly to the case of the silver toner 100, a covered top portion of the white toner 200 is exposed. For this reason, in the primary transfer position TY, TM, TC, and the TK, the white toner 200 contacts with the photoconductor drum 21, and a conductive path is secured along the spherical pigment 210 between the photoconductor drum 21 and the transfer belt 31. Due to this, a transfer ratio easily decreases in the white toner 200 compared to that of the color toner 300, because the charges with the positive polarity are injected.

In addition, the volume average particle diameter of the spherical pigment 210 of the white toner 200 is larger than that of the pigment 310 of the color toner 300. For this reason, the spherical pigment 210 easily extends in the white toner 200 compared to the color toner 300, and the transport path (refer to arrow E) is easily secured along the spherical pigment 210 between the photoconductor drum 21 and the transfer belt 31. Also in this point, a transfer ratio easily decreases in the white toner 200 compared to that in the color toner 300, because the charges with the positive polarity are injected.

In contrast to this, according to the exemplary embodiment, the image forming unit 20V that uses the silver toner 100 in which an injection of charges with a positive polarity occurs most easily among the silver toner 100, the white toner 200, and the color toner 300 is arranged on the most downstream side in the image forming units 20.

For this reason, since the silver toner 100 does not pass through the primary transfer positions T of the image forming unit 20W and the image forming units 20Y to 20K, charges with a positive polarity are rarely injected into the silver toner 100 compared to the comparison example shown in FIG. 10. Accordingly, a decrease in transfer ratio when the silver image which is formed using the silver toner 100 is transferred to the transfer belt 31 from the image forming unit 20V is suppressed compared to the comparison example shown in FIG. 10.

In addition, according to the exemplary embodiment, the image forming unit 20W that uses the white toner 200 in which an injection of charges with positive polarity easily occurs in the second place among the silver toner 100, the white toner 200, and the color toner 300 is arranged on the upstream side of the image forming unit 20V; however, the image forming unit is arranged on the downstream side of the image forming units 20Y to 20K.

For this reason, the white toner 200 passes through the primary transfer position T of the image forming unit 20V; however, the white toner does not pass through the primary transfer positions T of the image forming units 20Y to 20K. For this reason, charges with a positive polarity are rarely injected into the white toner 200 compared to the comparison example shown in FIG. 10. Accordingly, a decrease in transfer ratio when the white image which is formed using the white toner 200 is transferred to the transfer belt 31 from the image forming unit 20W is suppressed compared to the comparison example shown in FIG. 10.

Measurement of Transfer Ratio

Figure 13:
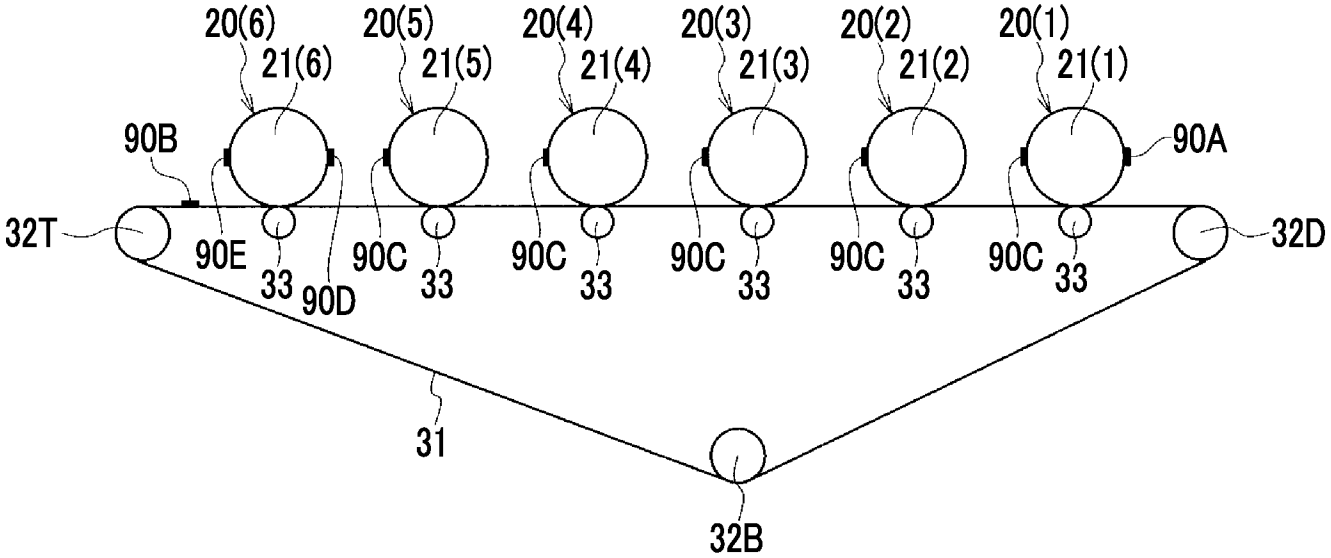
FIG. 13 is a diagram which describes measuring of a transfer ratio.

Here, a transfer ratio of an image when the respective image forming units 20V, 20W, and 20C in six image forming units 20 are arranged on the most upstream side (position of reference numeral 20(1) in FIG. 13) and that when on the respective image forming units 20V, 20W, and 20C are arranged on the most downstream side (position of reference numeral 20(6) in FIG. 13) are measured. In this measurement, as the image forming apparatus 10, a six-color printer obtained by reconstructing Color 1000 Press (manufactured by Fuji Zerox Co., Ltd.) is used. In addition, the measurement is performed under a circumstance of a temperature of 10° C., and a humidity of 15%.

In a measurement of a transfer ratio in the image forming unit 20(1) that is arranged on the most upstream side, a solid image (patch) of a predetermined size is formed in a photoconductor drum 21(1), and the solid image is transferred to the transfer belt 31. In addition, in image forming units 20(2), 20(3), 20(4), 20(5), and 20(6) that are not measurement targets, only a transfer operation using the primary transfer roll 33 is performed. The transfer ratio is obtained from a toner amount of the solid image on the transfer belt 31 after passing through six primary transfer positions T (toner amount in 90B in FIG. 13), when a toner amount of the solid image in the photoconductor drum 21(1) (toner amount in 90A in FIG. 13) is set to 100. The toner amount is obtained by, for example, suctioning a toner on the photoconductor drum 21(1) and a toner of the solid image of the transfer belt 31 using a suction device, and measuring a weight of the suctioned toner using an electronic balance. In addition, the toner amount of the solid image on the transfer belt 31 may be set to a value which is obtained by subtracting a total amount of toner which is attached to each of photoconductor drums 21(1), 21(2), 21(3), 21(4), 21(5), and 21(6) (total amount of toner in 90C and 90E in FIG. 13) after passing through each primary transfer position T from a toner amount in 90A in FIG. 13.

In a measurement of a transfer ratio in the image forming unit 20(6) that is arranged on the most downstream side, a solid image (patch) of a predetermined size is formed in the photoconductor drum 21(6), and the solid image is transferred to the transfer belt 31. The transfer ratio is obtained from a toner amount of the solid image on the transfer belt 31 (toner amount in 90B in FIG. 13), when a toner amount of the solid image in the photoconductor drum 21(6) (toner amount in 90D in FIG. 13) is set to 100. The toner amount is obtained by, for example, suctioning a toner on the photoconductor drum 21(6) and a toner of the solid image of the transfer belt 31 using a suction device, and measuring a weight of the suctioned toner using an electronic balance. In addition, the toner amount of the solid image on the transfer belt 31 may be set to a value which is obtained by subtracting an amount of toner which is attached to the photoconductor drum 21(6) (toner amount in 90E in FIG. 13) after passing through the primary transfer position T from a toner amount in 90D in FIG. 13.

Figure 14:
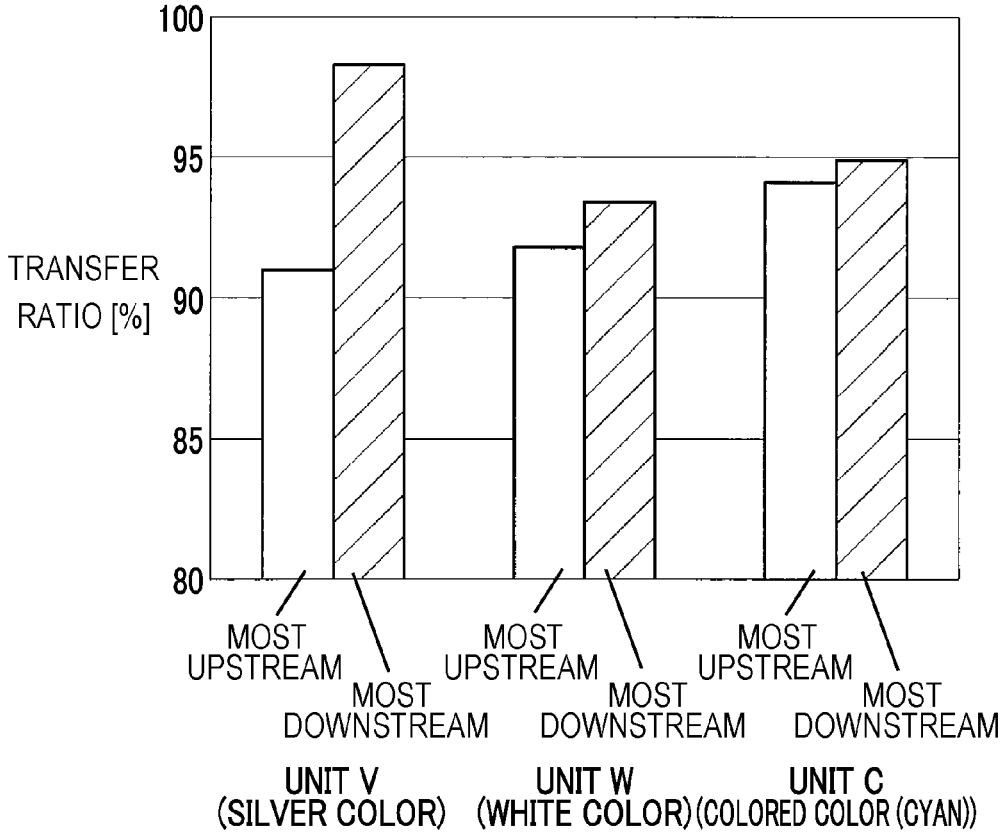
FIG. 14 is a graph which shows a measurement result of the transfer ratio.

A graph which denotes a result of the above described measurement is shown in FIG. 14. In FIG. 14, a transfer ratio when being arranged on the most upstream side (position of reference numeral 20(1) in FIG. 13) is denoted by a white bar, and a transfer ratio when being arranged on the most downstream side (position of reference numeral 20(6) in FIG. 13) is denoted by a bar with slanted lines. As denoted in the graph in FIG. 14, a decrease in transfer ratio is largest when the image forming unit 20V that forms a silver image is arranged on the most upstream side. A decrease in transfer ratio is second largest when the image forming unit 20W that forms a white image is arranged on the most upstream side.

Accordingly, an effect of suppressing a decrease in transfer ratio is high when the image forming unit 20V is arranged on the most downstream side. In addition, in the image forming unit 20W, though an effect of suppressing a decrease in transfer ratio is low compared to a case in which the image forming unit 20V is arranged on the most downstream side, the effect of suppressing the decrease in transfer ratio is high compared to a case in which the image forming units 20Y to 20K are arranged on the most downstream side. Accordingly, as in the exemplary embodiment, it is considered that arranging the image forming units 20Y to 20K, 20W, and 20V in this order from the upstream side is an optimal arrangement when suppressing a decrease in transfer ratio.

Evaluation

In the evaluation, transfer ratios of the silver image (silver toner 100), the white image (white toner 200), and a toner image of cyan (cyan toner) in the image forming apparatus 10 according to the exemplary embodiment, and the comparison example shown in FIG. 10 are evaluated.

Also in the evaluation, similarly to the above described measurement of the transfer ratio, the above described six-color printer obtained by reconstructing Color 1000 Press (manufactured by Fuji Zerox Co., Ltd.) is used. In addition, the evaluation is performed under a circumstance of a temperature of 10° C., and a humidity of 15%.

The transfer ratios in the exemplary embodiment and the comparison example are evaluated using A, B, and C using a visual observation of an image as follows.

A: transfer ratio is good to an extent that there is little density reduction

B: transfer property is good to an extent that there is no visible density reduction C: transfer property is bad to an extent that there is visible density reduction As a result of the evaluation, as shown in FIG. 15, in the configuration of the exemplary embodiment, the silver toner 100, the white toner 200, and the cyan toner get A in the evaluation of the transfer ratio. In the comparison example, the silver toner 100, the white toner 200, and the cyan toner get C, B, and A, respectively, in the evaluation of the transfer ratio. In this manner, in the configuration of the exemplary embodiment, a result that the transfer ratios of the silver toner 100 and the white toner 200 are excellent compared to the configuration in the comparison example is obtained.

First Modification Example

The image forming apparatus 10 according to the exemplary embodiment is set to a tandem-type image forming apparatus; however, it is not limited to this. For example, the apparatus may be an image forming apparatus 600 that is shown in FIG. 16 including a rotary developing device.

Figure 16:
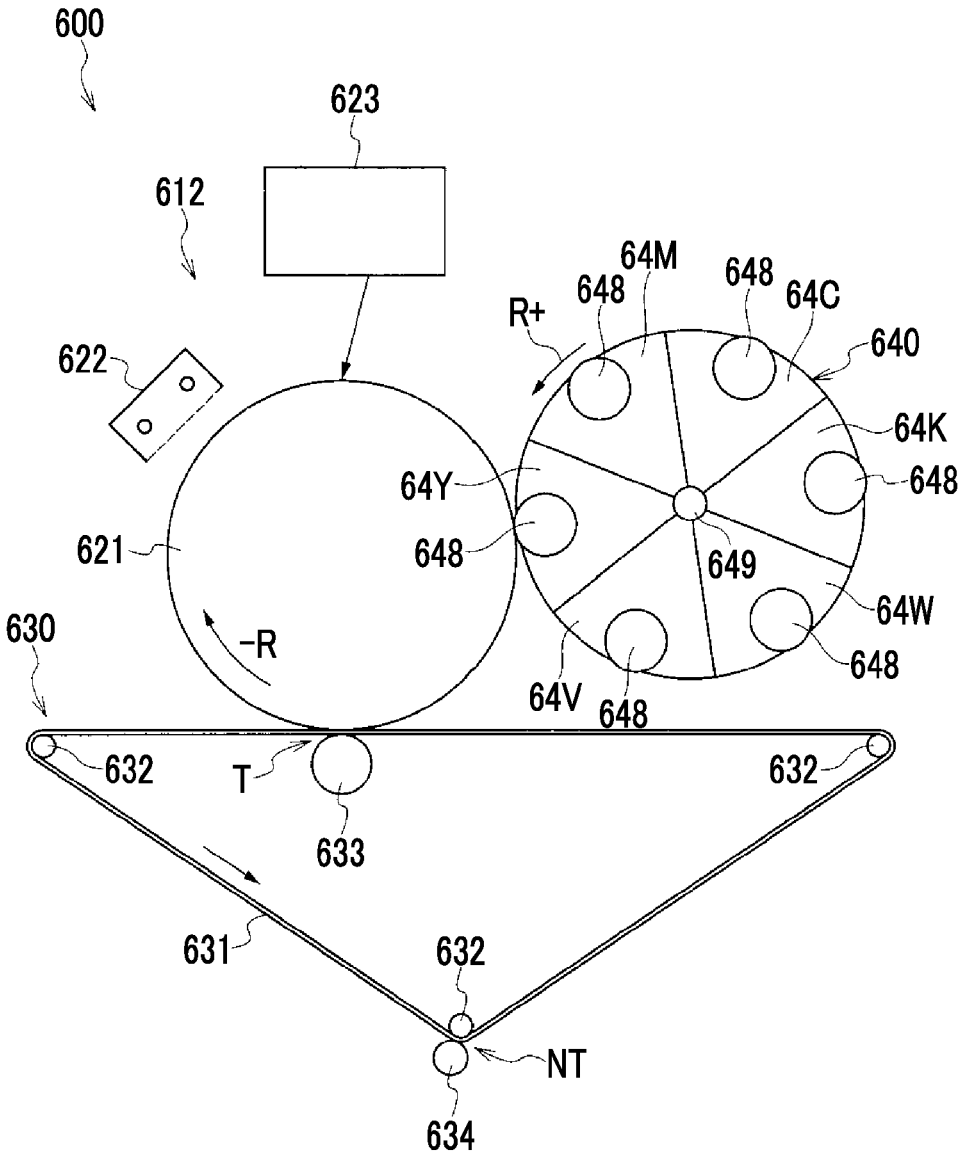
FIG. 16 is a schematic view which illustrates an image forming apparatus according to a first modification example which includes a rotary developing device.

As shown in FIG. 16, the image forming apparatus 600 includes a toner image forming unit 612 (an example of forming unit) that forms a toner image, and a transfer unit 630 that transfers the toner image which is formed using the toner image forming unit 612 to a recording medium P.

The toner image forming unit 612 includes a photoconductor drum 621 that rotates in the arrow −R direction, and a charger 622 that charges the photoconductor drum 621. The toner image forming unit 612 further includes an exposure unit 623 that forms an electrostatic latent image on the photoconductor drum 621 by exposing the photoconductor drum 621 that is charged using the charger 622, and a rotary developing device 640 that forms a toner image by developing the electrostatic latent image which is formed on the photoconductor drum 621 using the exposure unit 623.

The transfer unit 630 includes a transfer belt 631 (an example of medium) that is wound around plural rolls 632, a primary transfer roll 633 (an example of transfer unit) that transfer the toner image of the photoconductor drum 621 to the transfer belt 631 at a primary transfer position T, and a secondary transfer roll 634 which transfers the toner image that is superimposed on the transfer belt 631 to the recording medium P at a secondary transfer position NT.

The rotary developing device 640 includes a rotary shaft 649, and developing units 64Y, 64M, 64C, 64K, 64W, and 64V of yellow (Y), magenta (M), cyan (C), black (K), white (W), and silver (V) that are arranged at the periphery of the rotary shaft 649. In the developing units 64Y, 64M, 64C, 64K, 64W, and 64V, a toner of each color is accommodated, and a developing roll 648 for attaching the toner of each color to the photoconductor drum 621 is included.

When the rotary developing device 640 is rotated in the arrow +R direction by 60° at a central angle, the developing units 64Y, 64M, 64C, 64K, 64W, and 64V that perform a developing process at a developing position which faces the outer peripheral face a photoreceptor body 62 are switched. In the image forming apparatus 600, the developing process is performed in order of the developing units 64Y, 64M, 64C, 64K, 64W, and 64V. Accordingly, in the image forming apparatus 600, toner images are formed on the photoconductor drum 621 in order of yellow (Y), magenta (M), cyan (C), black (K), white (W), and silver (V), and are sequentially transferred to the transfer belt 631 when processes of charging, exposing, developing, and primary transfer are performed.

In the image forming apparatus 600, the developing unit 64V in which the silver toner 100 is used performs the developing process finally. For this reason, since the silver toner 100 of a silver image passes through the primary transfer position T only once, charges with a positive polarity are rarely injected into the silver toner 100 compared to a case in which the silver toner 100 passes through the primary transfer position T plural times (comparison example). Accordingly, it is possible to suppress a decrease in transfer ratio when a silver image formed using the silver toner 100 is transferred to the transfer belt 631.

In addition, in the developing unit 64W in which the white toner 200 is used, a developing process is performed after the developing units 64Y, 64M, 64C, and 64K, and before the developing unit 64V. Due to this, since the white toner 200 of a white image passes through the primary transfer position T twice, charges with a positive polarity are rarely injected into the white toner 200 compared to a case in which the white toner 200 passes through the primary transfer position T three times or more (comparison example). Accordingly, it is possible to suppress a decrease in transfer ratio when the white image formed using the white toner 200 is transferred to the transfer belt 631.

Second Modification Example

Figure 17:
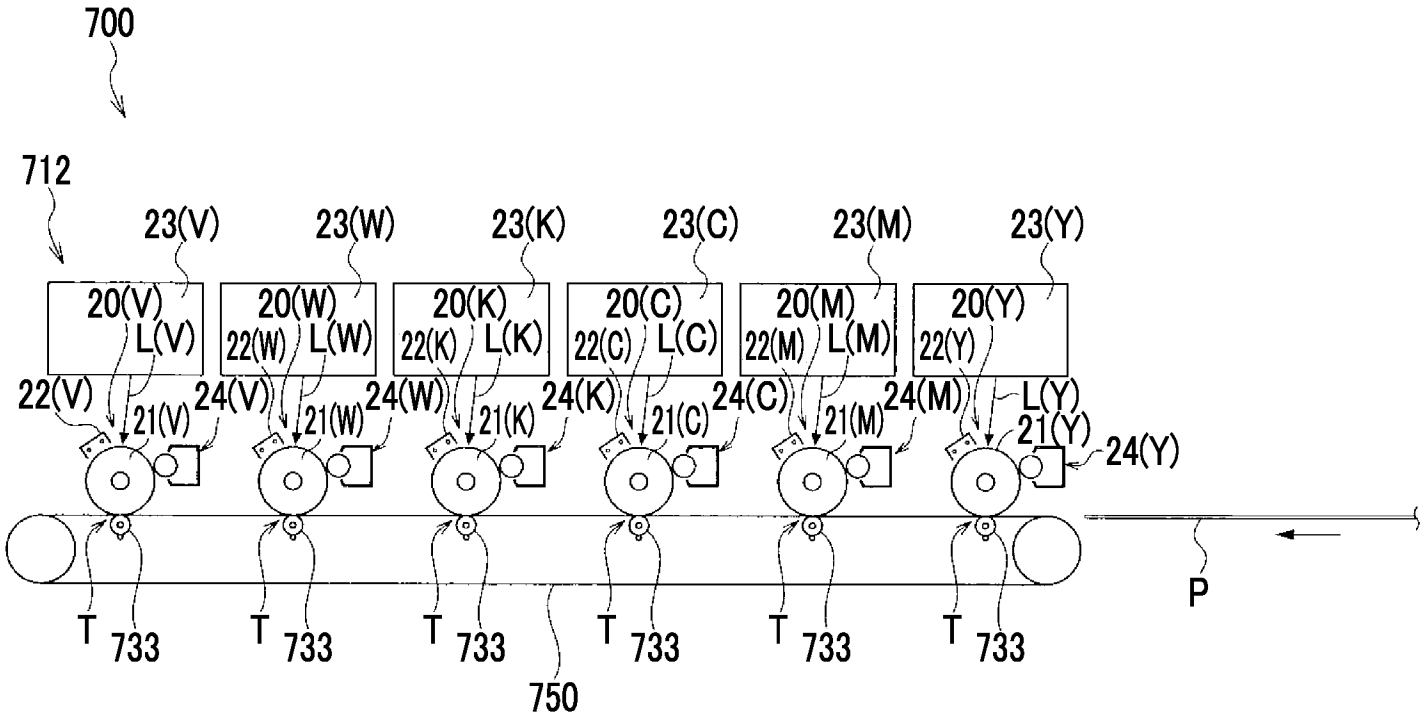
FIG. 17 is a schematic view which shows an image forming apparatus according to a second modification example of a direct transfer type.

The image forming apparatus 10 according to the exemplary embodiment is set to the tandem-type image forming apparatus; however, it is not limited to this, and a direct transfer-type image forming apparatus 700 which is shown in FIG. 17 may be used.

As shown in FIG. 17, the image forming apparatus 700 includes a toner image forming unit 712 (an example of forming unit) that forms a toner image, and a transfer roll 733 (an example of transfer unit) that transfers the toner image which is formed using the toner image forming unit 712 to a recording medium P (an example of medium).

In this manner, in the image forming apparatus 700, the recording medium P functions as an example of a medium. In addition, as described above, in the image forming apparatuses 10 and 600, the transfer belts 31 and 631 function as an example of a medium. Accordingly, a target to which a toner image, which is formed when a latent image is developed in a holding member (photoconductor drums 21 and 621) that holds an image, is firstly transferred from the holding member corresponds to the medium in the exemplary embodiment.

In the image forming apparatus 700, the recording medium P is transported using an annular transport belt 750. A transfer roll 733 is arranged in the inner periphery face of the transfer belt 750.

The toner image forming unit 712 includes image forming units 20Y, 20M, 20C, 20K, 20W, and 20V (image forming section) that form toner images of each color of yellow (Y), magenta (M), cyan (C), black (K), white (W), and silver (V).

The image forming units 20Y, 20M, 20C, 20K, 20W, and 20V (hereinafter, referred to as 20Y to 20V) are arranged in this order from the upstream side to the downstream side in the transport direction of the recording medium P. In addition, each configuration of the image forming unit 20Y to 20V is the same as that which is described above.

In the image forming apparatus 700, the image forming unit 20V in which silver toner 100, among the silver toner 100, white toner 200, and color toner 300, in which an injection of charges with positive polarity occurs most easily is used is arranged on the most downstream side among the image forming units 20.

For this reason, since the silver toner 100 does not pass through primary transfer positions T of the image forming units 20W and 20Y to 20K, charges with a positive polarity are rarely injected into the silver toner 100 compared to the comparison example shown in FIG. 10. Accordingly, it is possible to suppress a decrease in transfer ratio when transferring a silver image which is formed using the silver toner 100 to the recording medium P from the image forming unit 20V, compared to the comparison example shown in FIG. 10.

In addition, in the image forming apparatus 700, the image forming unit 20W that uses the white toner 200 in which an injection of charges with positive polarity easily occurs in the second place among the silver toner 100, the white toner 200, and the color toner 300 is arranged on the upstream side of the image forming unit 20V; however, the unit is arranged on the downstream side of the image forming units 20Y to 20K.

For this reason, the white toner 200 passes through the primary transfer position T of the image forming unit 20V; however, the white toner does not pass through the primary transfer positions T of the image forming units 20Y to 20K. For this reason, charges with a positive polarity are rarely injected into the white toner 200 compared to the comparison example shown in FIG. 10, and accordingly, it is possible to suppress a decrease in transfer ratio when transferring a white image which is formed using the white toner 200 to the recording medium P from the image forming unit 20W, compared to the comparison example shown in FIG. 10.

Other Modification Examples

In the exemplary embodiment, toner of yellow (Y), magenta (M), cyan (C), and black (K) are used as the third toner; however, there is no limitation to this. As the third toner, transparent toner, and color toner of red, blue, green, orange, violet, or the like, may be used. In addition, as the transparent toner, toner in which a pigment is not contained may be used.

In addition, in the exemplary embodiment, the toner image forming unit 12 includes the image forming unit 20W in which the white toner 200 is used; however, there is no limitation to this. For example, the toner image forming unit 12 may be configured of image forming units 20 of five colors without including the image forming unit 20W. In this case, the color toner 300 functions as an example of the second toner, and a color image is grasped as an example of the second image.

In addition, in the exemplary embodiment, the image forming unit 20W is arranged on the downstream side of the image forming units 20Y to 20K; however, there is no limitation to this. For example, the image forming unit 20W may be arranged on the upstream side of the image forming units 20Y to 20K. In this case, the white toner 200 and the color toner 300 may function as an example of the second toner, and a white image and a color image may be grasped as the second image.

In addition, in the exemplary embodiment, the silver toner 100 is used in the image forming unit 20V; however, there is no limitation to this, and for example, another metal color such as a gold color may be used.

In addition, in the exemplary embodiment, the silver toner 100 as an example of the first toner includes the flat pigment 110 which contains aluminum (an example of metal); however, there is no limitation to this. As the first toner, for example, a flat pigment which contains metal such as brass, bronze, nickel, stainless steel, and zinc, or a flat pigment which contains metal oxide such as titanium oxide may be used.

In addition, in the exemplary embodiment, the white toner 200 as an example of the second toner includes the spherical pigment 210 which contains titanium oxide (an example of metal oxide); however, there is no limitation to this. As the second toner, for example, a spherical pigment which contains metal such as aluminum, brass, bronze, nickel, stainless steel, and zinc, or a spherical pigment which contains metal oxide other than titanium oxide may be used.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a forming unit that forms a first image using a first toner including a flat pigment containing a first metal or a first metal oxide, and forms a second image using a second toner that does not include any flat pigment containing a second metal or a second metal oxide, a maximum length of the second toner being smaller than that of the first toner; and a transfer unit that transfers the second image and the first image to a medium in order of the second image and the first image.

2. The image forming apparatus according to claim 1, wherein the following relationship is satisfied:

$$A1 \geq B1 > C1$$

where A1 denotes the maximum length of the first toner when the first toner is viewed from above with the flat pigment being is placed on a flat plane, B1 denotes a length of the first toner along a direction perpendicular to the maximum length of the first toner when the first toner is viewed from above, and C1 denotes a length of the first toner along a direction perpendicular to the flat plane with the second toner being placed on the flat plane.

3. The image forming apparatus according to claim 1, wherein

A2 is substantially equal to B2, and

A2 is substantially equal to C2, where A2 denotes a length of the second toner in a first direction parallel to a flat plane when the second toner is viewed from above with the second toner being placed on the flat plane, B2 denotes a length of the second toner in a second direction perpendicular to the first direction and parallel to the flat plane when the second toner is viewed from above with the second toner being placed on the flat plane, and C2 denotes a thickness of the second toner in a direction perpendicular to the flat plate with the second toner being placed on the flat plane.

4. The image forming apparatus according to claim 1, wherein the first metal is at least one selected from a group consisting of aluminum, brass, bronze, nickel, stainless steel, and zinc, and the first metal oxide is titanium oxide.

5. The image forming apparatus according to claim 1, wherein the forming unit forms the second image using the second toner that includes a spherical pigment containing a third metal or a third metal oxide.

6. The image forming apparatus according to claim 5, wherein the forming unit forms a third image using a third toner that includes none of the flat pigment and the spherical pigment, a maximum length of the third toner is smaller than that of the second toner, and the transfer unit transfers the third image, the second image, and the first image to the medium in order of the third image, the second image, and the first image.

7. An image forming apparatus comprising:

a forming unit that forms a first image using a first toner including a flat pigment containing a first metal or a first metal oxide, and forms a second image using a second toner which does not include any flat pigment containing a second metal or a second metal oxide and which includes a pigment having a volume average particle diameter is smaller than that of the flat pigment of the first toner; and a transfer unit that transfers the second image and the first image to a medium in order of the second image and the first image.

8. The image forming apparatus according to claim 7, wherein the following relationship is satisfied:

$$A1 \geq B1 > C1$$

where A1 denotes the maximum length of the first toner when the first toner is viewed from above with the flat pigment being is placed on a flat plane, B1 denotes a length of the first toner along a direction perpendicular to the maximum length of the first toner when the first toner is viewed from above, and C1 denotes a length of the first toner along a direction perpendicular to the flat plane with the second toner being placed on the flat plane.

9. The image forming apparatus according to claim 7, wherein

A2 is substantially equal to B2, and

A2 is substantially equal to C2, where A2 denotes a length of the second toner in a first direction parallel to a flat plane when the second toner is viewed from above with the second toner being placed on the flat plane, B2 denotes a length of the second toner in a second direction perpendicular to the first direction and parallel to the flat plane when the second toner is viewed from above with the second toner being placed on the flat plane, and C2 denotes a thickness of the second toner in a direction perpendicular to the flat plate with the second toner being placed on the flat plane.

10. The image forming apparatus according to claim 7, wherein the first metal is at least one selected from a group consisting of aluminum, brass, bronze, nickel, stainless steel, and zinc, and the first metal oxide is titanium oxide.

11. The image forming apparatus according to claim 7, wherein the pigment of the second toner is a spherical pigment.

12. The image forming apparatus according to claim 11, wherein the forming unit forms a third image using third toner that includes none of the flat pigment and the spherical pigment, and includes a pigment having a volume average particle diameter smaller than that of the spherical pigment of the second toner, and the transfer unit transfers the third image, the second image, and the first image to a medium in order of the third image, the second image, and the first image.

* * * * *